US012545538B2

(12) United States Patent
Ito et al.

(10) Patent No.: US 12,545,538 B2
(45) Date of Patent: Feb. 10, 2026

(54) IMAGE FORMING APPARATUS

(71) Applicant: CANON KABUSHIKI KAISHA, Tokyo (JP)

(72) Inventors: Takahiro Ito, Chiba (JP); Yuya Hamaji, Chiba (JP)

(73) Assignee: Canon Kabushiki Kaisha, Tokyo (JP)

( * ) Notice: Subject to any disclaimer, the term of this patent is extended or adjusted under 35 U.S.C. 154(b) by 36 days.

(21) Appl. No.: 18/775,576

(22) Filed: Jul. 17, 2024

(65) Prior Publication Data

US 2025/0026594 A1 Jan. 23, 2025

(30) Foreign Application Priority Data

Jul. 21, 2023 (JP) ..... 2023-119367

(51) Int. Cl.
*B65H 5/36* (2006.01)
*B65H 5/06* (2006.01)

(52) U.S. Cl.
CPC ..... *B65H 5/36* (2013.01); *B65H 5/062* (2013.01); *B65H 2402/441* (2013.01); *B65H 2404/144* (2013.01); *B65H 2601/11* (2013.01)

(58) Field of Classification Search
CPC . B65H 5/062; B65H 5/36; B65H 5/38; B65H 9/004; B65H 9/006; B65H 2402/44; B65H 2402/441; B65H 2402/45; B65H 2404/144; B65H 2601/11
See application file for complete search history.

(56) References Cited

U.S. PATENT DOCUMENTS

2013/0164066 A1* 6/2013 Nakamura ..... G03G 15/6529 271/225
2015/0003860 A1* 1/2015 Shin ..... G03G 21/1638 399/98
2015/0239689 A1* 8/2015 Taniguchi ..... G03G 21/1633 271/264
2016/0291518 A1* 10/2016 Taniguchi ..... G03G 15/6529

FOREIGN PATENT DOCUMENTS

JP 2015227907 A 12/2015

* cited by examiner

*Primary Examiner* — Prasad V Gokhale
(74) *Attorney, Agent, or Firm* — Canon U.S.A., Inc. IP Division

(57) ABSTRACT

An image forming apparatus includes an image forming main body unit, an openable and closable portion disposed on the image forming main body unit, the openable and closable portion being disposed to be openable and closable between a closed position and an open position, a registration roller pair including a first roller and a second roller, the first roller being disposed on the image forming main body unit, the second roller being disposed on the openable and closable portion, a holding portion configured to hold the second roller, a first conveyance guide, a second conveyance guide configured to be pivotable about the second roller, a first urging portion configured to urge the second conveyance guide toward the first conveyance guide, and an abutting portion configured to be in contact with the first conveyance guide when the openable and closable portion is at the closed position.

9 Claims, 19 Drawing Sheets

IMAGE FORMING APPARATUS

BACKGROUND

Field

The present disclosure relates to an image forming apparatus forming an image on a sheet.

Description of the Related Art

In an existing electrophotographic image forming apparatus, skew of a sheet is corrected by causing a leading edge of the sheet to abut on a registration roller pair forming a nip portion that nips and conveys the sheet. Then, an intermediate transfer belt carrying a toner image and a secondary transfer roller form a nip portion, and the toner image is transferred to the sheet that is a recording medium. The image forming apparatus having such a configuration is widely known.

In such an image forming apparatus, to facilitate sheet jam recovery by a user, the nip portion is released during the jam recovery.

Japanese Patent Application Laid-Open NO. 2015-227907 discusses a configuration of an apparatus including a door pivotable relative to an apparatus main body. One roller of a registration roller pair is disposed on the apparatus main body, the other roller of the registration roller pair is provided on the door, and a nip portion of the registration roller pair is separated while being interlocked with opening of the door.

A registration lock member is further disposed on the apparatus main body in order to form the nip portion of the registration roller pair and to hold the other roller when the door is closed. When the door is closed, the other roller of the registration roller pair is held by the registration lock member.

In the image forming apparatus discussed above, however, a conveyance guide that is disposed on the door and guides a sheet to the nip portion of the registration roller pair is supported by a member different from the registration lock member. Thus, when the door is closed, it is difficult to guarantee relative position of the registration roller pair and the conveyance guide.

When the sheet is guided to the nip portion of the registration roller pair, a position of the leading edge of the sheet relative to the nip portion is varied, which may deteriorate accuracy of sheet skew correction by the registration roller pair.

SUMMARY

Various embodiments of the present disclosure are directed to an image forming apparatus that can improve positional accuracy of a conveyance guide relative to a registration roller pair.

According to one embodiment of the present disclosure, an image forming apparatus includes an image forming main body unit including an image forming unit configured to form an image to be transferred to a sheet, an openable and closable portion disposed on the image forming main body unit to be pivotable about a pivot shaft, the openable and closable portion being disposed to be openable and closable by pivoting between a closed position where a sheet conveyance path is formed and an open position where the sheet conveyance path is opened, a registration roller pair including a first roller and a second roller and configured to nip and convey the sheet, the first roller being disposed on the image forming main body unit, the second roller being disposed on the openable and closable portion and configured to form, with the first roller, a nip configured to nip the sheet when the openable and closable portion is at the closed position, a holding portion configured to hold the second roller of the registration roller pair to form the nip with the first roller when the openable and closable portion is at the closed position, a first conveyance guide disposed on the image forming main body unit upstream of the registration roller pair in a sheet conveyance direction, a second conveyance guide configured to be pivotable about the second roller of the registration roller pair and configured to face the first conveyance guide and guide, with the first conveyance guide, the sheet to the registration roller pair when the openable and closable portion is at the closed position, a first urging portion disposed on the openable and closable portion and configured to urge the second conveyance guide toward the first conveyance guide when the openable and closable portion is at the closed position, and an abutting portion disposed on the second conveyance guide and configured to be in contact with the first conveyance guide when the second conveyance guide is urged toward the first conveyance guide by the first urging portion when the openable and closable portion is at the closed position.

Further features of the present disclosure will become apparent from the following description of exemplary embodiments with reference to the attached drawings.

DESCRIPTION OF THE EMBODIMENTS

Figure 1:
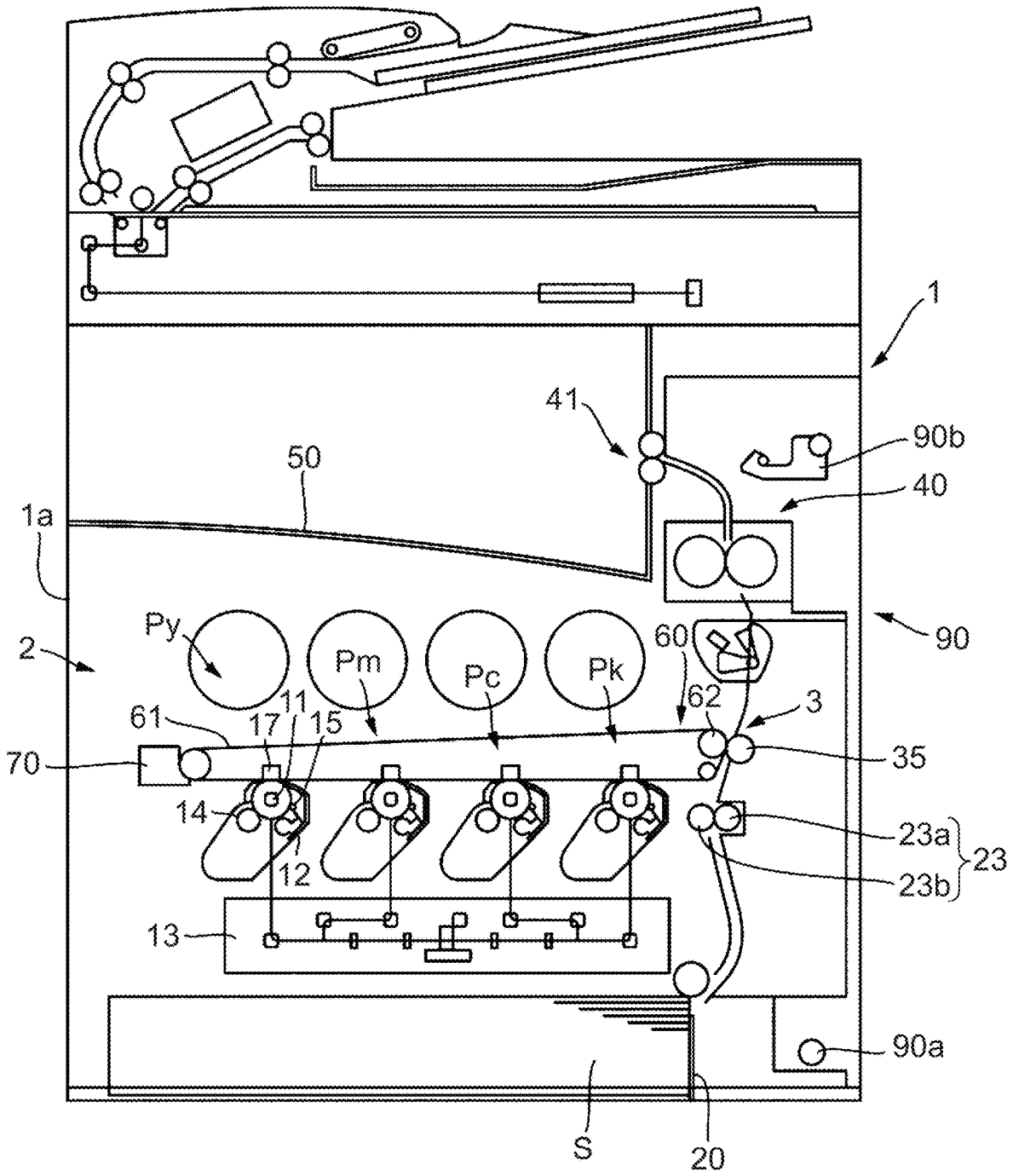
FIG. 1 is a cross-sectional view illustrating an image forming apparatus according to a first exemplary embodiment.

A first exemplary embodiment of the present disclosure is described in detail below with reference to FIG. 1 to FIG. 12. First, a general configuration of an image forming apparatus 1 according to the present exemplary embodiment is described with reference to FIG. 1. FIG. 1 is a cross-sectional view schematically illustrating the configuration of the image forming apparatus 1 according to the present exemplary embodiment. The image forming apparatus 1 is a laser beam printer of a tandem intermediate-transfer system using an electrophotographic process.

The image forming apparatus 1 can form a full color image or a monochrome image corresponding to print image data and output the image on a sheet S that is a recording medium.

[Image Forming Apparatus]

The image forming apparatus 1 includes an image forming unit 2 that forms an image on a sheet at a transfer nip 3 that is an example of an image forming position. The image forming unit 2 includes process cartridges Py, Pm, Pc, and Pk respectively corresponding to colors of yellow (Y), magenta (M), cyan (C), and black (K). The process cartridges Py, Pm, Pc, and Pk have similar configurations except that colors of toner are different from one another. Thus, the process cartridge Py for yellow (Y) is described herein, and descriptions of the other process cartridges Pm, Pc, and Pk are omitted.

The process cartridge Py includes a photosensitive drum 11, a charging roller 12, a developing unit 14, and a drum cleaner 15. After a surface of the photosensitive drum 11 is uniformly charged by the charging roller 12, an electrostatic latent image is formed on the photosensitive drum 11 by a laser scanner 13 driven based on a transmitted image information signal. The electrostatic latent image is visualized as a toner image by the developing unit 14. The toner image on the photosensitive drum 11 is primarily transferred to an intermediate transfer belt 61 by receiving a predetermined pressing force and an electrostatic load bias from a primary transfer roller 17. The intermediate transfer belt 61 is an example of an image bearing member, is positioned and disposed to an apparatus main body 1*a*, and bears the toner image. After the transfer, residual toner slightly remaining on the photosensitive drum 11 is removed and collected by the drum cleaner 15, and the photosensitive drum 11 prepares for the next image formation.

Sheets S are fed one by one from a sheet cassette 20, and each sheet S is conveyed to a registration roller pair 23. A loop is formed at a leading edge of the sheet S while the leading edge abuts onto a nip of the registration roller pair 23, and skew of the sheet S is accordingly corrected. Then, the registration roller pair 23 conveys the sheet S to a gap between a transfer driving roller 62 driving the intermediate transfer belt 61 and a secondary transfer outer roller 35 in synchronization with the toner image borne on the intermediate transfer belt 61. The secondary transfer outer roller 35 is integrally assembled to a secondary transfer unit 30 described below (see FIG. 2), and is separated from the intermediate transfer belt 61 and the transfer driving roller 62 when a door 90 is opened.

At a nip portion of the transfer driving roller 62 and the secondary transfer outer roller 35 disposed to face each other, a predetermined pressing force and an electrostatic load bias are applied. As a result, the color toner image on the intermediate transfer belt 61 is secondarily transferred to the sheet S. After the transfer, residual toner slightly remaining on the intermediate transfer belt 61 is removed and collected by a belt cleaner 70, and the intermediate transfer belt 61 prepares for the next image formation. The toner image transferred to the sheet S is fixed by being heated and pressurized by a fixing unit 40, and the sheet S is then discharged to a discharge tray 50 by a discharge roller pair 41. The intermediate transfer belt 61, and a plurality of stretching rollers including the transfer driving roller 62 around which the intermediate transfer belt 61 is stretched are integrated into a unit that is an intermediate transfer unit 60.

In other words, the image forming unit 2 includes the intermediate transfer belt 61 and the secondary transfer outer roller 35. The secondary transfer outer roller 35 is an example of a transfer roller, and is disposed in the secondary transfer unit 30 described below. When the door 90 is at a closed position, the secondary transfer outer roller 35 comes into contact with the intermediate transfer belt 61 to form the transfer nip 3 that is the image forming position. The secondary transfer outer roller 35 transfers the toner image borne on the intermediate transfer belt 61 to the sheet S at the transfer nip 3.

[Door]

The door 90 freely openable and closable relative to the apparatus main body 1*a* is formed on a right-side surface of the image forming apparatus 1 illustrated in FIG. 1. The apparatus main body 1*a* is an example of an image forming main body unit, and pivotally supports the door 90. The door 90 according to the present exemplary embodiment includes a pivot shaft 90*a* at a lower part thereof, and pivots about the pivot shaft 90*a*. A locking portion 90*b* is formed at an upper part of the door 90, and is locked into a locked portion formed in the apparatus main body 1*a*. By being locked with the locking portion 90*b*, the door 90 is closed relative to the apparatus main body 1*a*. In other words, the door 90 is an example of an openable and closable portion, is disposed in the apparatus main body 1*a* so as to be pivotable about the pivot shaft 90*a*, and is pivotally openable and closable between the closed position where a sheet conveyance path is formed and an open position where the sheet conveyance path is opened.

Figure 2:
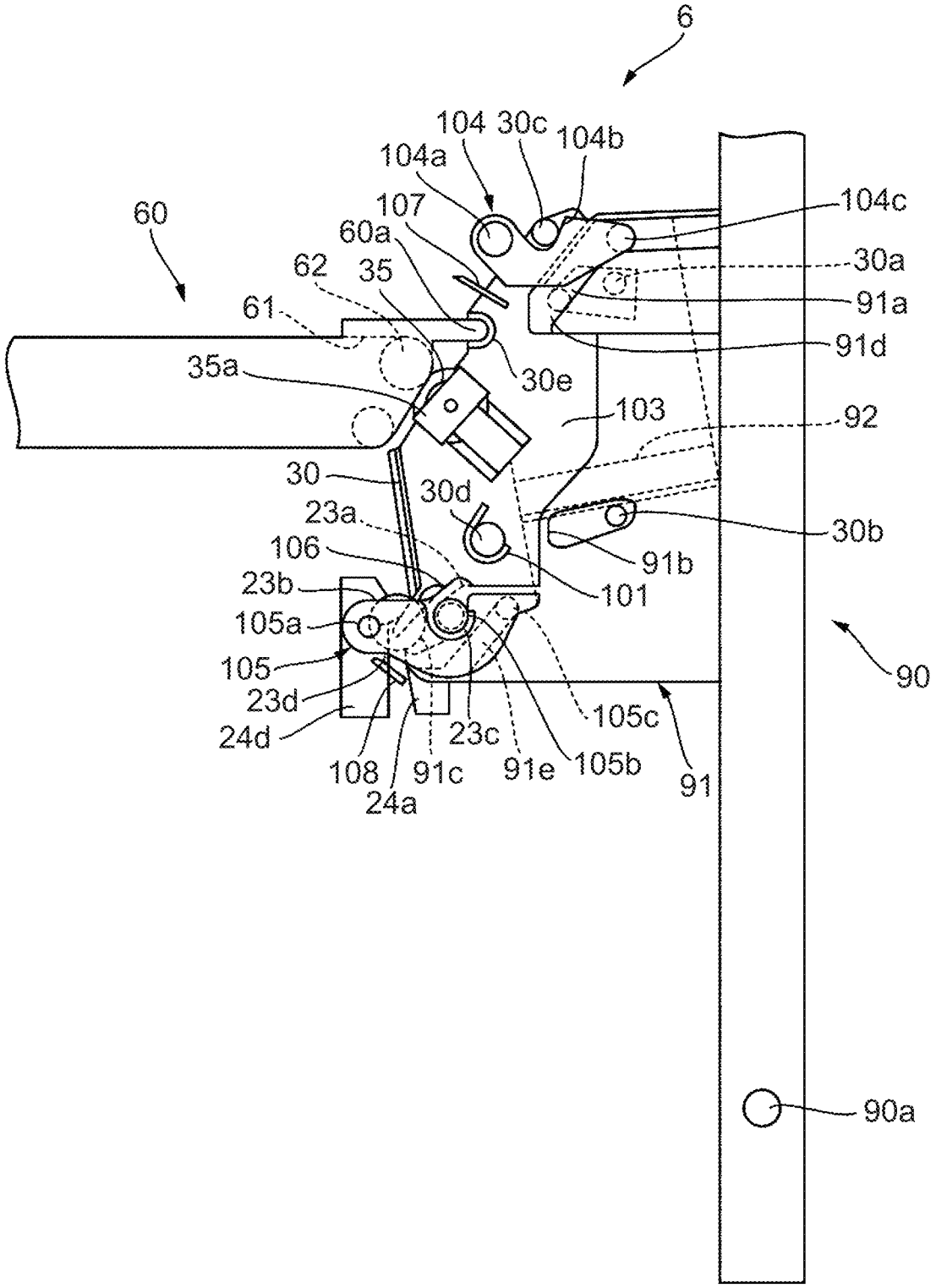
FIG. 2 is a front view illustrating a door according to the first exemplary embodiment.
Figure 3:
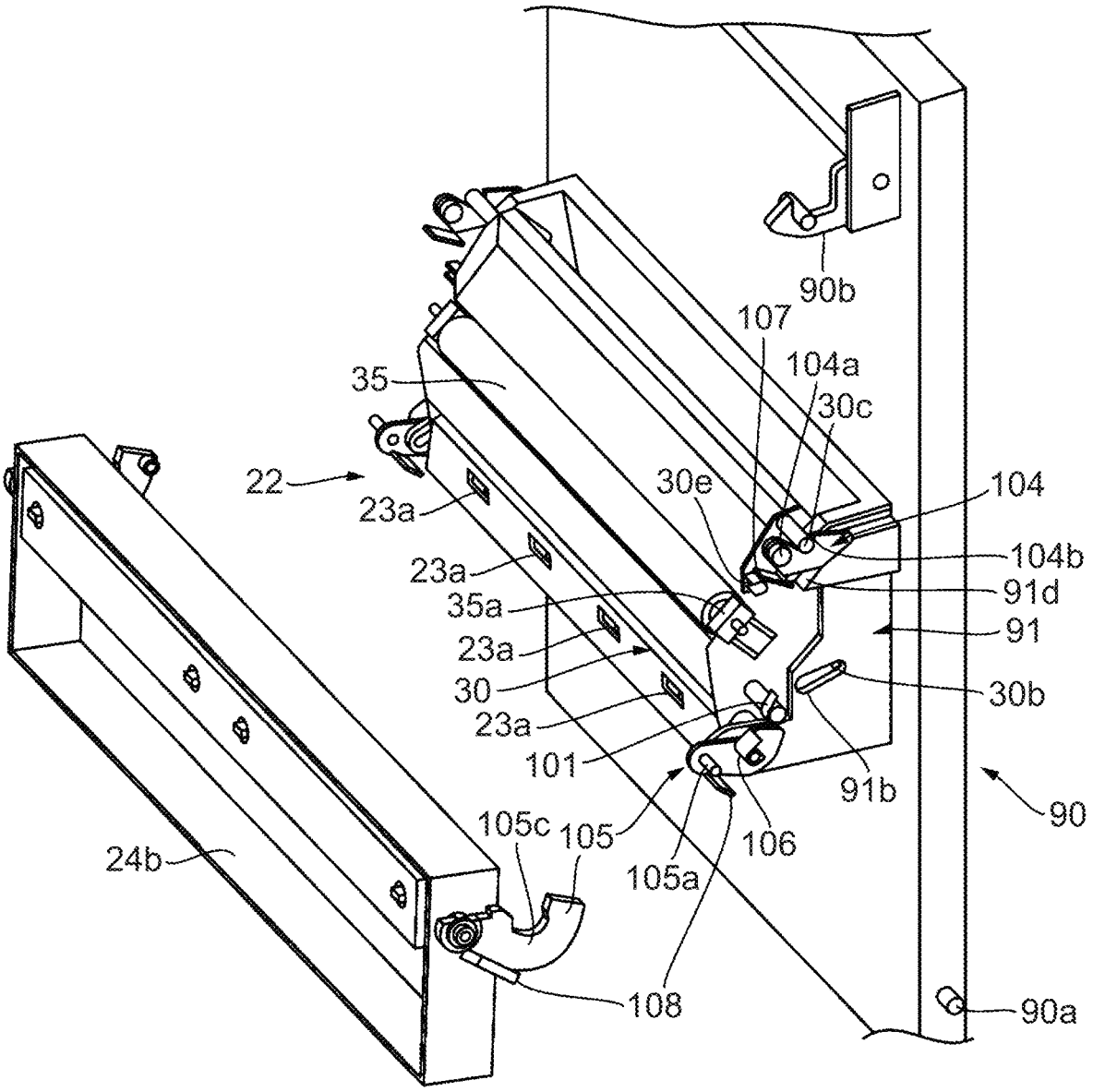
FIG. 3 is a perspective view illustrating the door according to the first exemplary embodiment.
Figure 4:
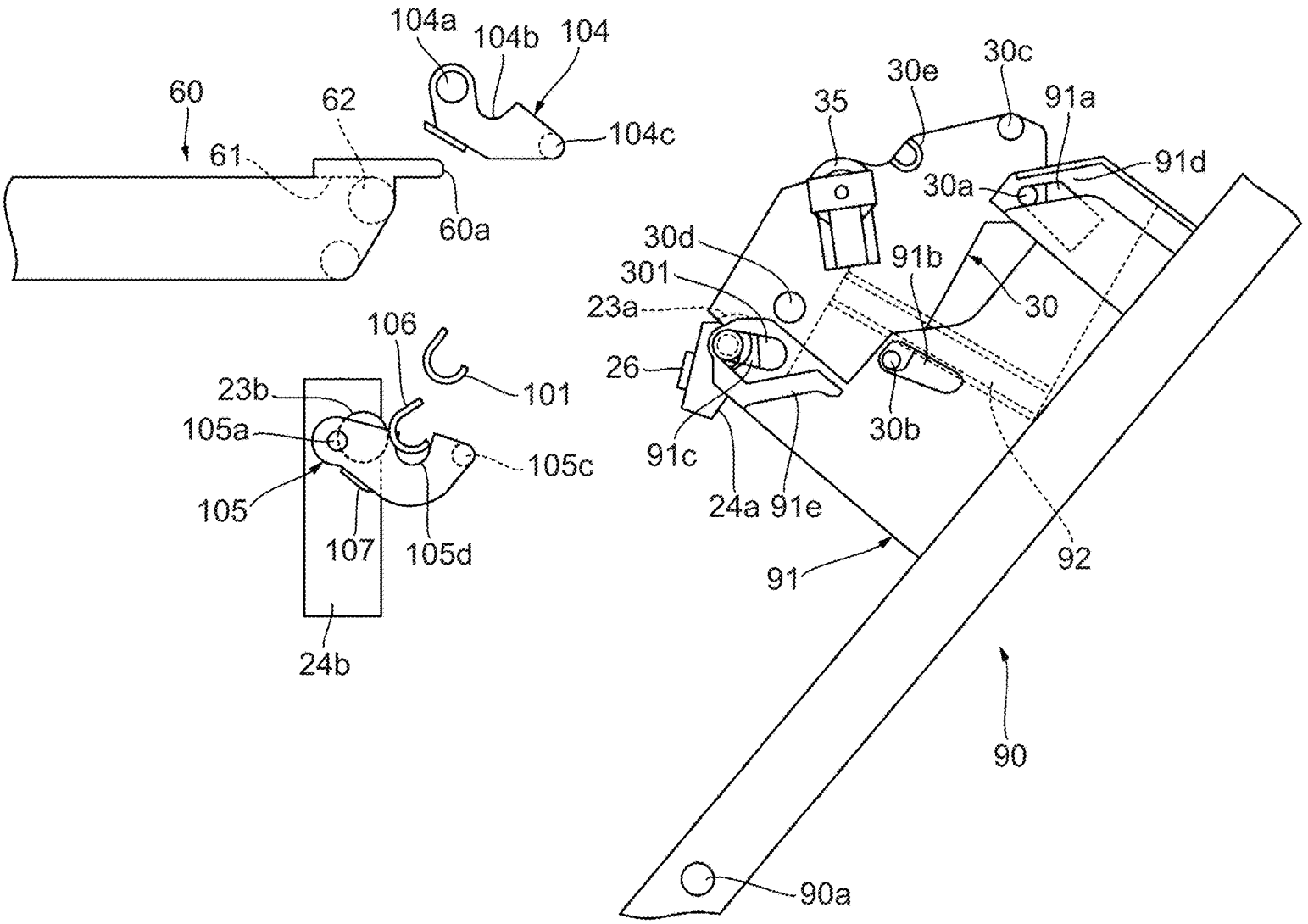
FIG. 4 is a front view illustrating a state where the door is at an open position according to the first exemplary embodiment.

A relationship between the door 90 and peripheral components of the door 90 is described with reference to FIG. 2 and FIG. 3. FIG. 2 is a front view illustrating a closed state where the door 90 is at the closed position. FIG. 3 is an exploded perspective view illustrating the peripheral components of the door 90 in the closed state. As illustrated in FIG. 2, the door 90 is an exterior member that pivots about the pivot shaft 90*a* and serves as a part of an exterior of the apparatus main body 1*a*. As illustrated in FIG. 2 to FIG. 4, a unit holding portion 91 is integrally disposed inside the door 90. The unit holding portion 91 includes a movable unit portion movably attached to the door 90. The movable unit portion includes the secondary transfer unit 30 and a guide unit 22.

The secondary transfer unit 30 is an example of a transfer guide, includes the secondary transfer outer roller 35, and is disposed so as to be movable relative to the door 90 when the door 90 is at the open position. The unit holding portion 91 holds the secondary transfer unit 30 including the secondary transfer outer roller 35 at both end parts in a longitudinal direction.

The unit holding portion 91 includes an engagement mechanism for holding the secondary transfer unit 30. More specifically, a columnar upper restricting portion 30*a* disposed on the secondary transfer unit 30 engages with an upper restricting guide hole 91*a* formed in an upper part of the unit holding portion 91. On the other hand, a columnar lower restricting portion 30*b* disposed on the secondary transfer unit 30 engages with a lower restricting guide hole 91*b* formed in a lower part of the unit holding portion 91. As illustrated in FIG. 2, the door 90 includes a floating spring 92 urging the secondary transfer unit 30 toward the intermediate transfer unit 60. With such a configuration, the secondary transfer unit 30 is held so as to be movable integrally with the unit holding portion 91 disposed on the door 90 while being urged toward the intermediate transfer unit 60 by the floating spring 92.

[Secondary Transfer Unit]

A configuration of the secondary transfer unit 30 and peripheral components thereof is described with reference to FIG. 2 to FIG. 4. FIG. 4 is a side view illustrating an open state where the door 90 is positioned at the open position. A cylindrical positioning portion 30*c* is disposed on an inner side of the apparatus, i.e., on an intermediate transfer unit 60 side at an upper part of the secondary transfer unit 30. To position and fix the positioning portion 30*c* to the apparatus main body 1*a*, the apparatus main body 1*a* includes a transfer lock arm 104. The transfer lock arm 104 pivots about a pivot center 104*a* and locks the positioning portion 30*c* to fix the secondary transfer unit 30 in the closed state illustrated in FIG. 2.

In the secondary transfer unit 30, a fitting protrusion 30*d* to be engaged with the apparatus main body 1*a* is disposed below the secondary transfer outer roller 35 and closer to the intermediate transfer unit 60 than the lower restricting portion 30*b* is. As illustrated in FIG. 2 and FIG. 4, the apparatus main body 1*a* includes a U-shaped fitting groove 101 to be engaged with the fitting protrusion 30*d*. The secondary transfer unit 30 is configured such that the fitting protrusion 30*d* is fitted into the fitting groove 101 and such that the secondary transfer unit 30 is pivotable about the fitting protrusion 30*d* relative to the apparatus main body 1*a* when the door 90 is opened and closed.

In other words, the secondary transfer unit 30 includes the fitting protrusion 30*d* that is an example of a shaft portion having a center axis in a width direction intersecting a sheet conveyance direction. The apparatus main body 1*a* includes the fitting groove 101 that is an example of a groove portion with which the fitting protrusion 30*d* is engaged. When the door 90 pivots from the open position to the closed position, the fitting protrusion 30*d* is engaged with the fitting groove 101, and the secondary transfer unit 30 pivots about the fitting protrusion 30*d* and is positioned relative to the apparatus main body 1*a*. With the configuration, the secondary transfer unit 30 is positioned relative to the image forming apparatus 1.

At the upper part of the secondary transfer unit 30, the positioning portion 30*c* is positioned by the transfer lock arm 104, and at a lower part of the secondary transfer unit 30, the fitting protrusion 30*d* is positioned by the fitting groove 101. In the present exemplary embodiment, the positioning portion 30*c*, the transfer lock arm 104, the fitting protrusion 30*d*, and the fitting groove 101 correspond to a second positioning portion 6. The second positioning portion 6 positions the secondary transfer outer roller 35 relative to the intermediate transfer belt 61 by positioning the secondary transfer unit 30 relative to the apparatus main body 1*a* when the door 90 is at the closed position.

Further, the secondary transfer unit 30 is also positioned relative to the intermediate transfer unit 60 in the closed state. As illustrated in FIG. 4, a fitting groove 30*e* is formed to be open on an intermediate transfer unit 60 side of the secondary transfer unit 30. Thus, as illustrated in FIG. 2, when the door 90 is closed, a positioning protrusion 60*a* formed in the intermediate transfer unit 60 is fitted into the fitting groove 30*e* of the secondary transfer unit 30, and the secondary transfer unit 30 is positioned relative to the intermediate transfer unit 60.

[Positioning Configuration of Registration Roller Pair]

The secondary transfer unit 30 includes a registration roller holding portion 30*f* that holds a registration driving roller bearing 23*c* disposed at an end part in a longitudinal direction of a registration driving roller 23*a* of the registration roller pair 23. The registration driving roller 23*a* is held so as to be rotatable relative to the secondary transfer unit 30 and to be movable in a pivoting direction of the door 90 and in a vertical direction. When the door 90 is closed, the registration driving roller bearing 23*c* is positioned in the apparatus main body 1*a* by a U-shaped fitting groove 106 and a registration lock arm 105 disposed in the apparatus main body 1*a*. A specific positioning configuration of the registration roller pair 23 is described below.

The registration roller pair 23 includes the registration driving roller 23*a* and a registration driven roller 23*b*, and conveys the sheet S toward the transfer nip 3. The registration driven roller 23*b* is an example of a first roller and is disposed in the apparatus main body 1*a*. The registration driving roller 23*a* is an example of a second roller, and is disposed in the movable unit portion. The registration driving roller 23*a* and the registration driven roller 23*b* form a nip 23*n* (see FIG. 8) holding the sheet S when the door 90 is at the closed position.

Figure 5A:
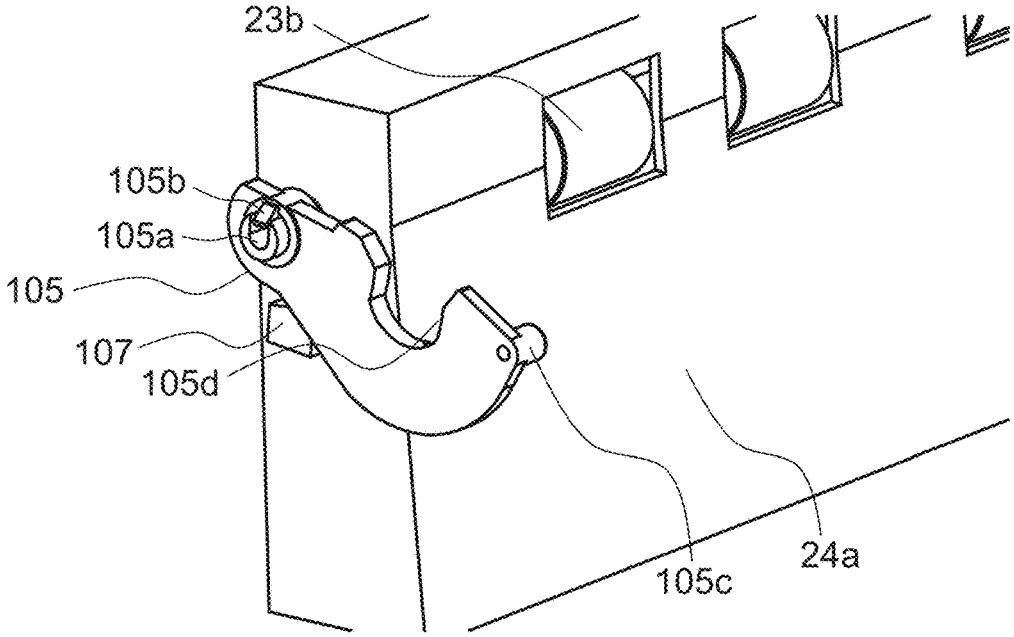
FIG. 5A is a perspective view illustrating a holding mechanism portion when the door is at the open position according to the first exemplary embodiment, in a state where a restricting member is lowered to a lowest position.
Figure 5B:
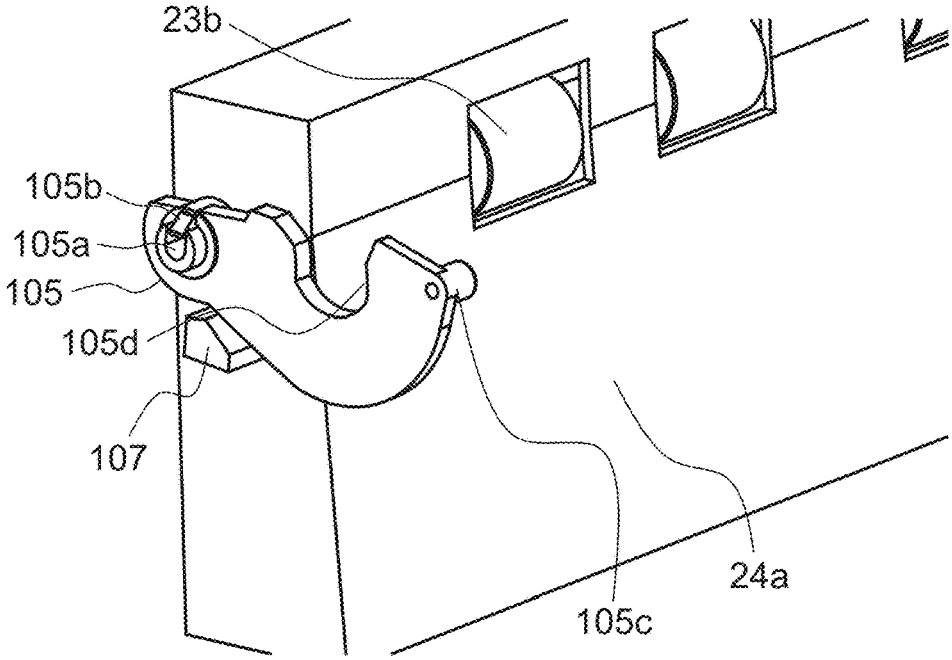
FIG. 5B is a perspective view illustrating the holding mechanism portion when the door is at the open position according to the first exemplary embodiment, in a state where the restricting member is slightly lifted.
Figure 6A:
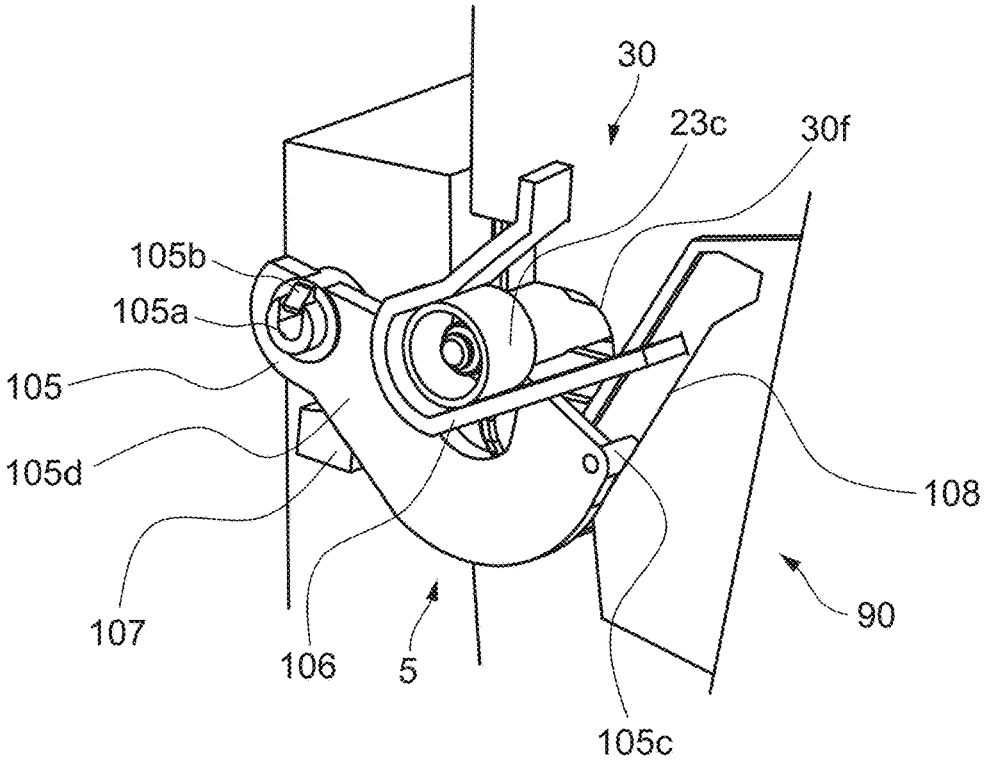
FIG. 6A is a perspective view illustrating the holding mechanism portion when the door is at a position near a closed position according to the first exemplary embodiment, in a state immediately before the door is at the closed position.
Figure 6B:
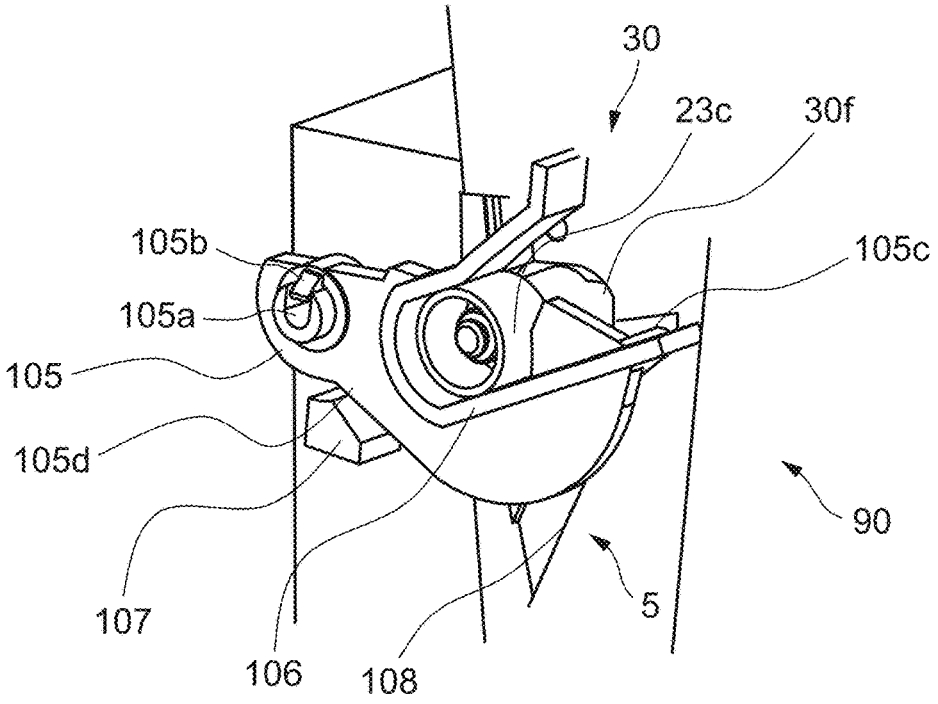
FIG. 6B is a perspective view illustrating the holding mechanism portion when the door is at the closed position according to the first exemplary embodiment, in a state where the door is at the closed position.
Figure 7:
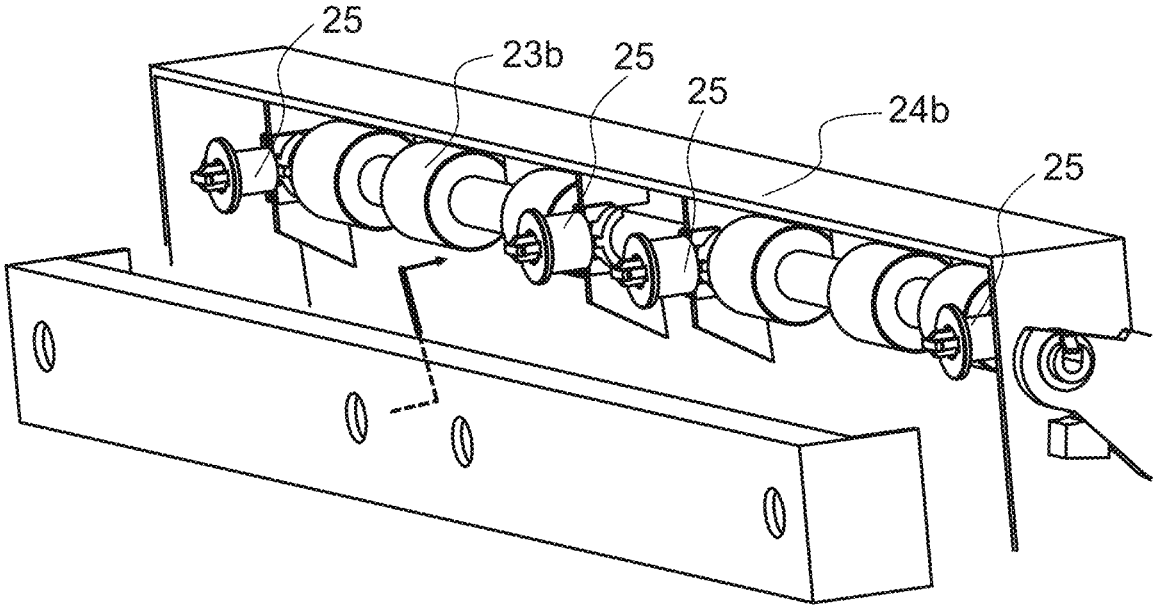
FIG. 7 is a perspective view illustrating a back side of a first conveyance guide according to the first exemplary embodiment.
Figure 8:
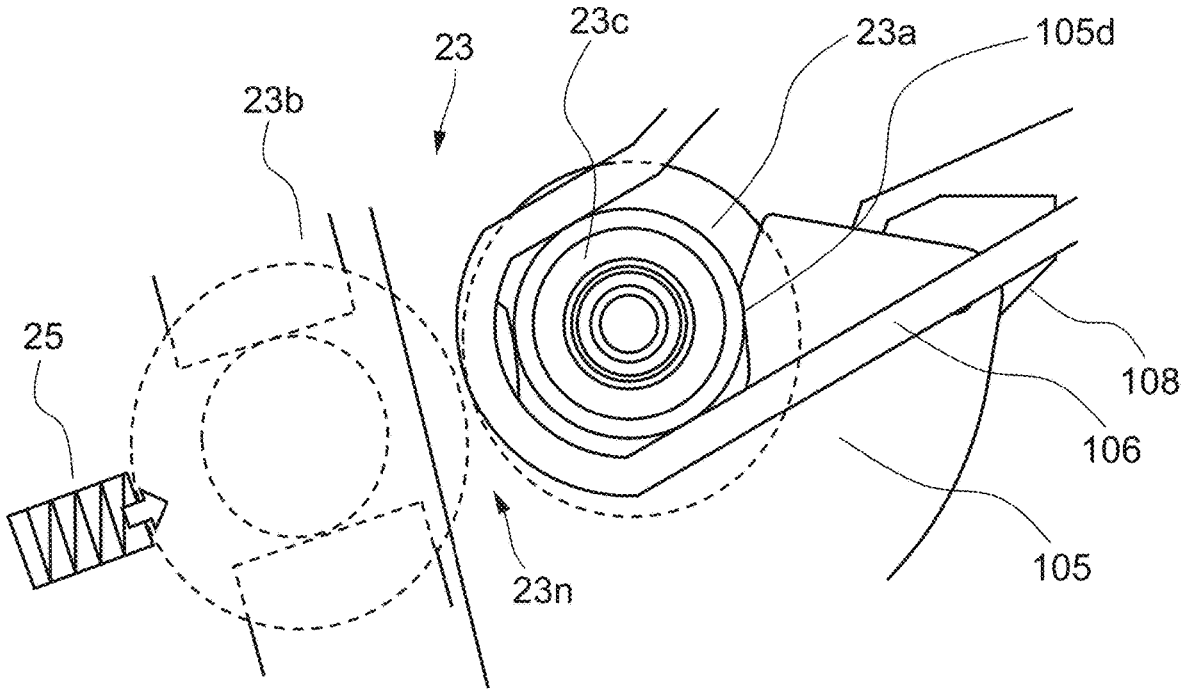
FIG. 8 is a front view illustrating a registration roller pair when the door is at the closed position according to the first exemplary embodiment.

The positioning configuration of the registration roller pair 23 is described with reference to FIG. 5A to FIG. 8. FIG. 5A and FIG. 5B are perspective views each illustrating a holding mechanism portion when the door 90 is in the open state. FIG. 6A and FIG. 6B are perspective views each illustrating the holding mechanism portion when the door 90 is in the closed state. FIG. 7 is a perspective view illustrating a back side of a sheet conveyance surface of a first conveyance guide 24*b*. FIG. 8 is a front view illustrating the registration roller pair 23 when the door 90 is in the closed state.

As illustrated in FIG. 5A and FIG. 5B, the registration lock arm 105 is set to be freely pivotable about an arm pivot center 105*a* relative to the apparatus main body 1*a*, and is attached thereto with an arm engagement claw 105*b* disposed on the apparatus main body 1*a*. A standby angle of the registration lock arm 105 is determined by the registration lock arm 105 abutting on an arm restricting portion 107 in the state where the door 90 is opened. The present exemplary embodiment adopts a configuration in which the registration lock arm 105 is urged toward the arm restricting portion 107 by the own weight of the registration lock arm 105. However, the configuration is not limited thereto, and an elastic member urging the registration lock arm 105 toward the arm restricting portion 107 may be disposed.

The registration lock arm 105 includes a cylindrical arm shaft 105*c*. When the arm shaft 105*c* comes into contact with a guide groove 108 formed in the door 90, an attitude of the registration lock arm 105 is determined. In other words, in the state where the door 90 is opened, the registration lock arm 105 abuts on the arm restricting portion 107 and is released. At a certain angle during an operation for closing the door 90, the arm shaft 105*c* and the guide groove 108 come into contact with each other, and an angle of the registration lock arm 105 is changed to an angle at which the registration lock arm 105 is lifted. Then, when the door 90 is closed, the registration lock arm 105 is locked.

In other words, the registration lock arm 105 includes the arm shaft 105*c* that is an example of a guided portion, and is pivotally disposed on the apparatus main body 1*a*. The guide groove 108 is an example of a guide portion. When the door 90 pivots from the open position to the closed position, the guide groove 108 guides the arm shaft 105*c* to cause the registration lock arm 105 positioned at a release position to pivot. Further, when the door 90 is at the closed position, the guide groove 108 positions the registration lock arm 105 at a restricting position.

The registration lock arm 105 includes a registration roller holding portion 105*d* that restricts movement of the registration driving roller bearing 23*c* on the door 90 side in the above-described locked state. During a series of opening and closing operations of the door 90, the registration lock arm 105 pivots so as to hold the registration driving roller bearing 23*c* from below, and the movement of the registration driving roller bearing 23*c* in the vertical direction is restricted by the U-shaped fitting groove 106. Thus, movement of the registration driving roller 23*a* in the vertical direction is restricted by the fitting groove 106. In a right-left direction, the movement of the registration driving roller 23*a* toward the door 90 is restricted by the registration roller holding portion 105*d*, but the registration driving roller 23*a* is movable toward the registration driven roller 23*b*, i.e., is in a temporarily held state.

On the other hand, movement of the registration driven roller 23*b* of the registration roller pair 23 in the conveyance direction relative to the first conveyance guide 24*b* is restricted. In contrast, the registration driven roller 23*b* is movable toward the nip of the registration roller pair 23, and is urged toward the door 90 by a pressing member 25. In the present exemplary embodiment, a pressing force of the pressing member 25 is set as follows. In the present exemplary embodiment, the pressing force is set to about 4000 gf such that, when the registration roller pair 23 having a registration function conveys the sheet S, the registration roller pair 23 is not affected by other rollers, and when the registration roller pair 23 registers the sheet S, the leading edge of the sheet S is stopped and is not protruded from the nip 23*n*. However, the pressing force is not limited to about 4000 gf, and is appropriately settable depending on conditions, such as a size of the loop and a used sheet type.

When the registration driving roller 23*a* in the temporarily held state is pressed toward the door 90 by the pressing member 25, the registration driving roller 23*a* is positioned relative to the apparatus main body 1*a* with high accuracy. As described above, the movement of the registration driving roller bearing 23*c* in the vertical direction is restricted by the fitting groove 106, the registration driving roller 23*a* is pressed toward the registration roller holding portion 105*d* by the registration driven roller 23*b*, and the movement of the registration driving roller 23*a* toward the nip is accordingly restricted. As a result, the registration roller pair 23 is positioned relative to the apparatus main body 1*a* with high accuracy.

The image forming apparatus 1 further includes a first positioning portion 5 that is an example of a holding portion positioning the registration roller pair 23 relative to the apparatus main body 1*a* when the door 90 is at the closed position. The first positioning portion 5 includes the registration lock arm 105 and the pressing member 25. The registration lock arm 105 is an example of a restricting member, is disposed on the apparatus main body 1*a*, and is movable to the restricting position and the release position. As illustrated in FIG. 8, the registration lock arm 105 is at the restricting position when the registration lock arm 105 is at a position opposite to the registration driven roller 23*b* with the registration driving roller 23*a* therebetween in a direction of a virtual line connecting the rotation center of the registration driving roller 23*a* and the rotation center of the registration driven roller 23*b* when the door 90 is at the closed position. The release position is a position retreated from the restricting position. The pressing member 25 is an example of a second urging portion, is disposed in the first positioning portion 5, and urges the registration driven roller 23*b* toward the registration driving roller 23*a*.

When the door 90 is at the closed position, the registration lock arm 105 is at the restricting position, and the pressing member 25 urges the registration driven roller 23*b* toward the registration driving roller 23*a*. The registration driving roller bearing 23*c* of the registration driving roller 23*a* is brought into contact with the registration lock arm 105 to position the registration roller pair 23 relative to the apparatus main body 1*a*. When the door 90 is at the open position, the registration lock arm 105 is at the release position, and the positioning of the registration driving roller 23*a* is canceled.

[Positioning Configuration of Guide Unit]

Figure 9:
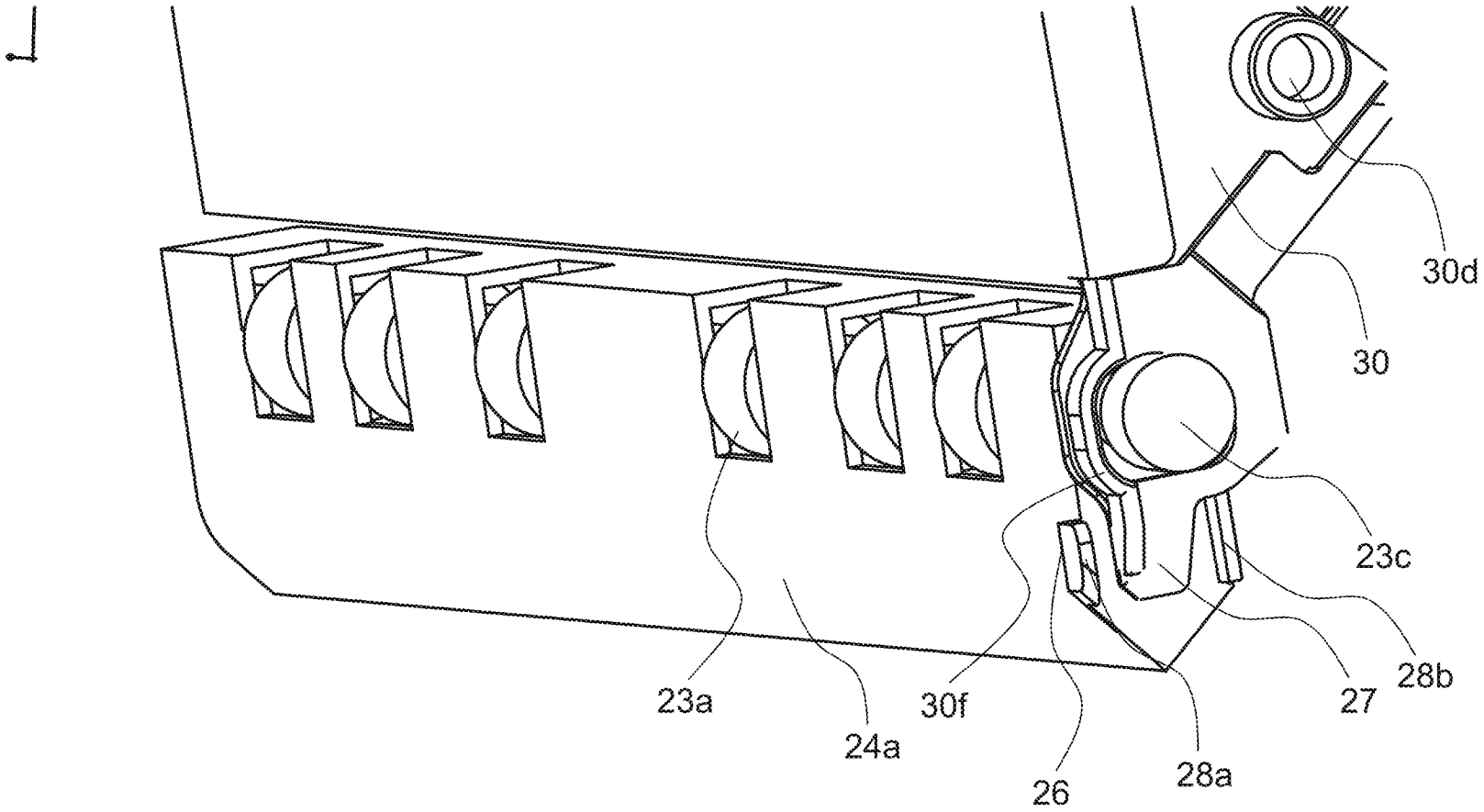
FIG. 9 is a perspective view illustrating a second conveyance guide according to the first exemplary embodiment.
Figure 10A:
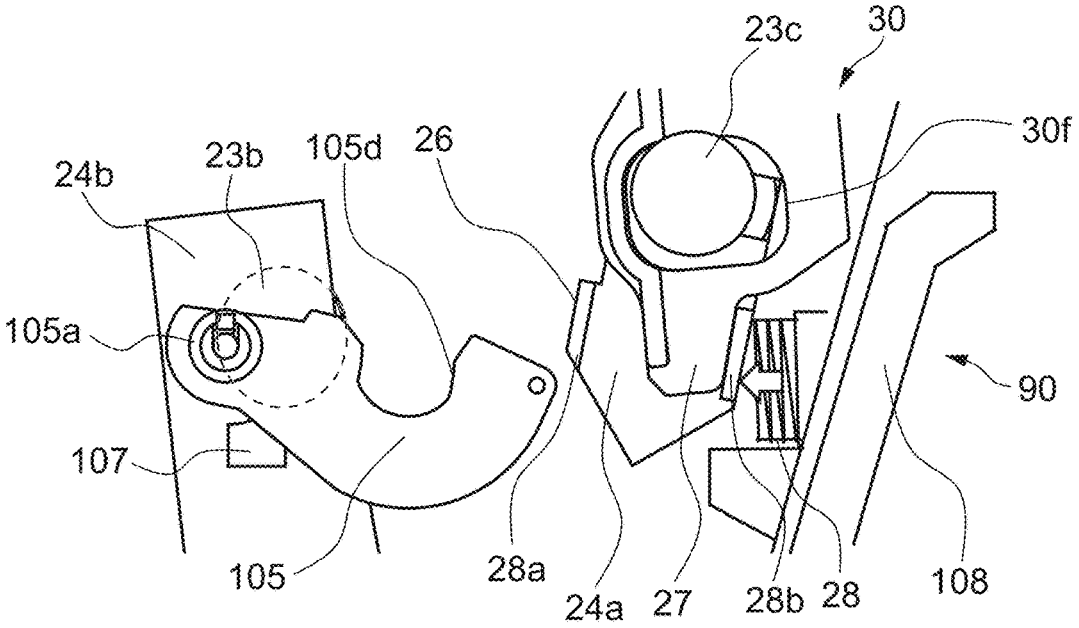
FIG. 10A is a front view illustrating the registration roller pair and the conveyance guides according to the first exemplary embodiment, in the state where the door is at the open position.
Figure 10B:
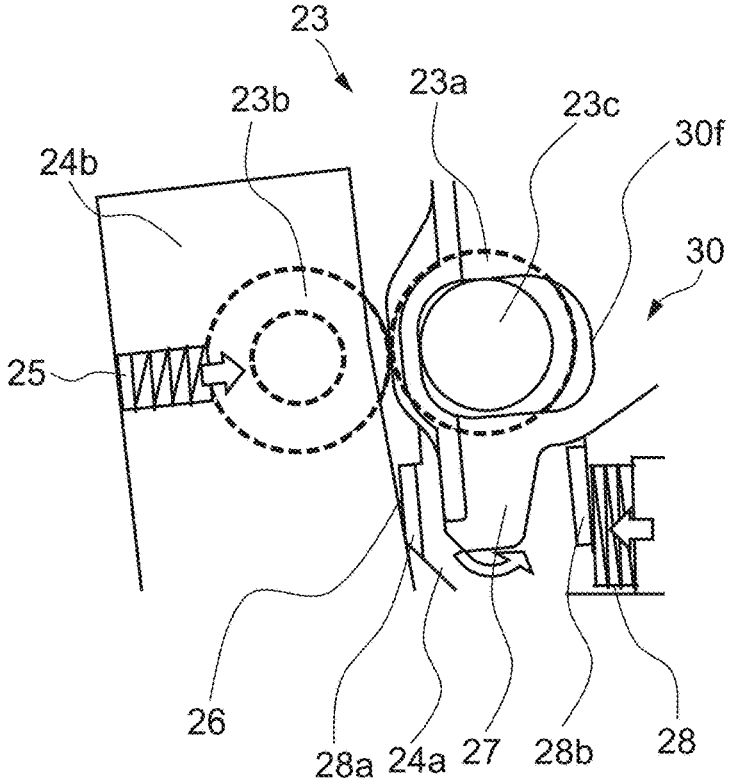
FIG. 10B is a front view illustrating the registration roller pair and the conveyance guides according to the first exemplary embodiment, in the state where the door is at the closed position.
Figure 11A:
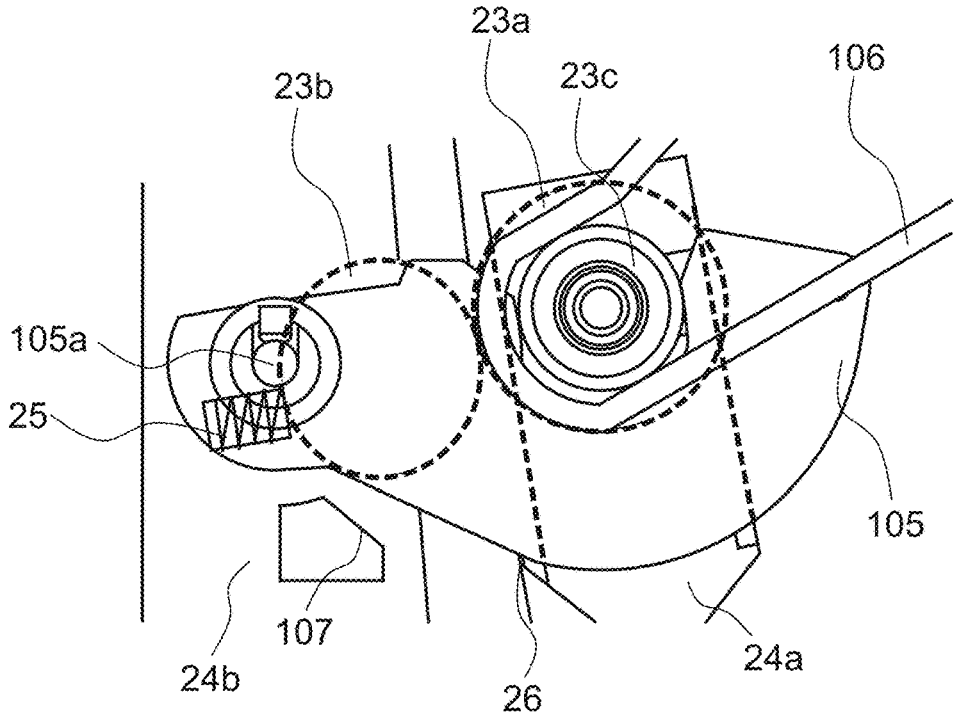
FIG. 11A is a front view illustrating the registration roller pair when the door is at the closed position according to the first exemplary embodiment.
Figure 11B:
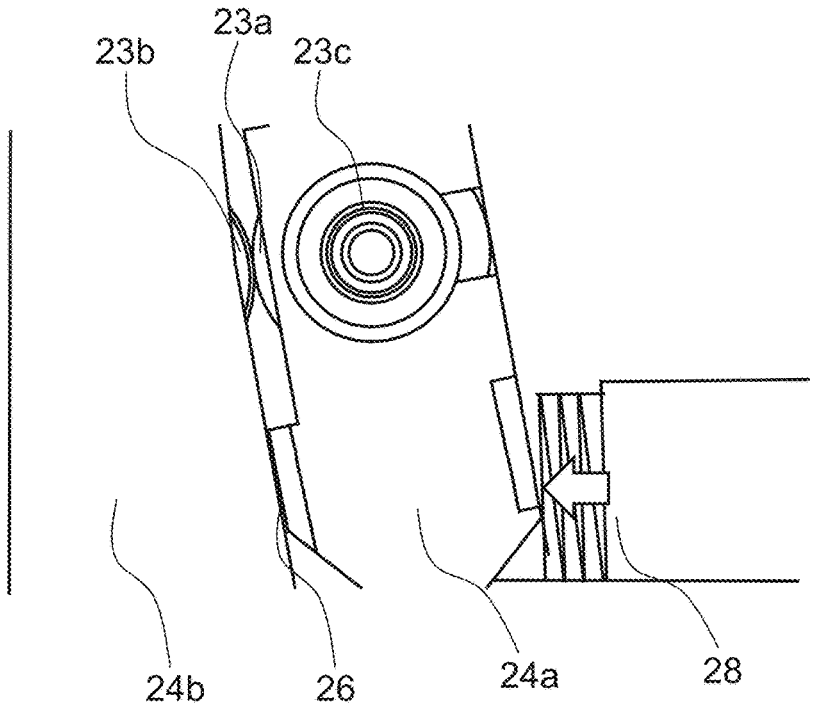
FIG. 11B is a front view illustrating the conveyance guides when the door is at the closed position according to the first exemplary embodiment.

A positioning configuration of the guide unit 22 is described with reference to FIG. 9 to FIG. 12. FIG. 9 is a perspective view illustrating a second conveyance guide 24*a*. FIG. 10A and FIG. 10B are front views illustrating the registration roller pair 23 and the conveyance guides when the door 90 is in the open state. FIG. 11A and FIG. 11B are front views illustrating the registration roller pair 23 and the conveyance guides when the door 90 is in the open state.

Figure 12:
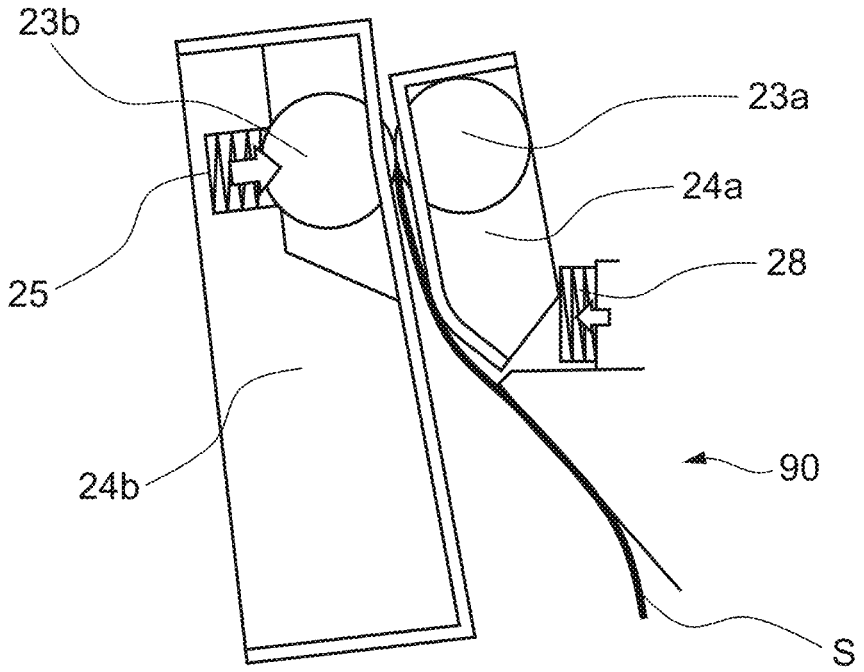
FIG. 12 is a cross-sectional view illustrating sheet registration behavior of the registration roller pair when the door is at the closed position according to the first exemplary embodiment.

FIG. 12 is a cross-sectional view illustrating sheet registration behavior of the registration roller pair 23 and the conveyance guides.

The guide unit 22 is disposed to be movable relative to the secondary transfer unit 30 when the door 90 is at the open position. The guide unit 22 includes the registration driving roller 23*a*, the registration driving roller bearing 23*c*, the second conveyance guide 24*a* pivotable about the registration driving roller 23*a*, and an abutting portion 26 disposed at an end part of the second conveyance guide 24*a* in a longitudinal direction.

The registration roller holding portion 30*f* and a restricting portion 27 are disposed at a lower part of the secondary transfer unit 30. In other words, the first conveyance guide 24*b* is disposed upstream of the registration roller pair 23 in the sheet conveyance direction, and is positioned relative to the apparatus main body 1*a*. The second conveyance guide 24*a* is disposed in the movable unit portion. When the door 90 is at the closed position, the second conveyance guide 24*a* faces the first conveyance guide 24*b* to guide, with the first conveyance guide 24*b*, the sheet S to the registration roller pair 23. The abutting portion 26 is disposed in the second conveyance guide 24*a*. When the door 90 is at the closed position, the abutting portion 26 is pressed against the first conveyance guide 24*b* to position the second conveyance guide 24*a* relative to the first conveyance guide 24*b*. In the present exemplary embodiment, the second conveyance guide 24*a* is supported by a rotary shaft of the registration driving roller 23*a*, and the registration driving roller 23*a* is rotatable relative to the second conveyance guide 24*a*. This makes it possible to improve positioning accuracy of the registration roller pair 23 and the second conveyance guide 24*a*. Further, as compared with a case where the second conveyance guide 24*a* is attached to the secondary transfer unit 30, positional accuracy of the second conveyance guide 24*a* relative to the registration roller pair 23 can be improved.

When the door 90 is in the open state, the guide unit 22 is held by the registration roller holding portion 30*f*, and is set to be movable within a range of the registration roller holding portion 30*f*. With regard to a pivotable angle, although rotation of the guide unit 22 is restricted by the restricting portion 27 coming into contact with protrusions 28*a* and 28*b* disposed on the secondary transfer unit 30 in the pivoting direction, the guide unit 22 is pivotable within a range therebetween. Thus, the guide unit 22 is maintained in a state where, while the guide unit 22 is pivotable, the restricting portion 27 is constantly in contact with the protrusion 28*b* by a pressing portion 28 described below. The protrusions 28*a* and 28*b* are examples of contacted portions. The restricting portion 27 comes into contact with the protrusions 28*a* and 28*b* in the pivoting direction of the guide unit 22, which restricts a pivoting range of the guide unit 22. In a case where the protrusions 28*a* and 28*b* are not disposed, as an extreme example of behavior, there is a risk that the door 90 is at the closed position while the guide unit 22 pivots 180 degrees and the guide unit 22 is positioned in an attitude different from a designed attitude. In contrast, in the present exemplary embodiment, the pivotable angle is restricted by the protrusions 28*a* and 28*b*. This makes it possible to eliminate such a possibility.

When the door 90 is closed, the guide unit 22 is restricted in the vertical direction by the U-shaped fitting groove 106 in movement similar to the above-described movement for positioning the registration driving roller 23*a* relative to the apparatus main body 1*a*. By the position of the guide unit 22 in the right-left direction being determined by the registration roller holding portion 105*d* and the registration driven roller 23*b*, the second conveyance guide 24*a* is positioned relative to the apparatus main body 1*a*. Further, when the abutting portion 26 disposed on the second conveyance guide 24*a* comes in contact with the first conveyance guide 24*b* and the second conveyance guide 24*a* is urged by the pressing portion 28 provided on the door 90, a positioning angle of the guide unit 22 relative to the apparatus main body 1*a* is determined.

The pressing portion 28 is an example of a first urging portion and is disposed on the door 90. When the door 90 is at the closed position, the pressing portion 28 urges the second conveyance guide 24*a* toward the first conveyance guide 24*b*, and presses the abutting portion 26 against the first conveyance guide 24*b*. In the present exemplary embodiment, the abutting portion 26 comes directly into contact with and is pressed against the first conveyance guide 24*b*; however, the configuration is not limited thereto. For example, the abutting portion 26 may be brought into contact with a frame of the apparatus main body 1*a* or the like. Even in such a case, the abutting portion 26 comes indirectly into contact with the first conveyance guide 24*b*.

As illustrated in FIG. 12, when the sheet S is registered, the sheet S forms a loop, and the loop comes in contact with the first conveyance guide 24*b* and pushes the guide unit 22 toward the door 90. Thus, it is necessary to set a pressing force of the pressing portion 28 so as not to be less than a pressing force by the loop. In the present exemplary embodiment, the pressing force of the pressing portion 28 is set to about 1000 gf. However, the pressing force of the pressing portion 28 is not limited to about 1000 gf, and is appropriately settable depending on a condition, such as a size of the loop and a used sheet type.

In the present exemplary embodiment, the secondary transfer unit 30 includes the restricting portion 27, and the guide unit 22 includes the protrusions 28*a* and 28*b*. However, the configuration is not limited thereto. The secondary transfer unit 30 may include two protrusions constituting a pair, and the guide unit 22 may include a restricting portion movable between the two protrusions. In other words, one of the secondary transfer unit 30 and the guide unit 22 includes a contact portion, and the other thereof includes contacted portions.

As described above, in the image forming apparatus 1 according to the present exemplary embodiment, when the door 90 is at the closed position, the abutting portion 26 positions the second conveyance guide 24*a* relative to the first conveyance guide 24*b*. As a result, as compared with the case where the second conveyance guide 24*a* is attached to the secondary transfer unit 30, positional accuracy of the second conveyance guide 24*a* relative to the registration roller pair 23 can be improved.

Further, the registration driving roller 23*a* is positioned by the registration lock arm 105, the registration roller holding portion 30*f*, and the registration driven roller 23*b*, and the abutting portion 26 comes in contact with the first conveyance guide 24*b* to position the second conveyance guide 24*a*. This makes it possible to position the guide unit 22 relative to the apparatus main body 1*a* with high accuracy. Therefore, it is possible to provide the image forming apparatus 1 including the registration roller pair 23 that has the sheet conveyance path released by being interlocked with the operation of opening the door 90, achieves high visibility when a sheet jam occurs, and can convey the sheet with high accuracy.

Further, in the image forming apparatus 1 according to the present exemplary embodiment, the second conveyance guide 24*a* is supported by the rotary shaft of the registration driving roller 23*a*, and the registration driving roller 23*a* is rotatable relative to the second conveyance guide 24*a*. Therefore, the second conveyance guide 24*a* serves as a conveyance guide pivoting about the registration driving roller 23*a* without deteriorating jam recovery property. This enhances the positional accuracy of the second conveyance guide 24*a* and the first conveyance guide 24*b* relative to the registration roller pair 23. Thus, it is possible to provide the image forming apparatus 1 that can improve accuracy of the registration function of the registration roller pair 23.

In the above-described exemplary embodiment, the case where the electrophotographic printer is adopted as the image forming apparatus 1 is described. However, the image forming apparatus 1 is not limited thereto, and may be an inkjet printer. In this case, the present exemplary embodiment is applicable to a registration roller pair and a conveyance guide upstream thereof for a recording unit that is an image forming unit.

A second exemplary embodiment of the present disclosure is described in detail with reference to FIG. 13 to FIG. 19. The present exemplary embodiment is different in configuration from the first exemplary embodiment in that a relative position between a pressing unit 29 that can press the second conveyance guide 24*a* and the second conveyance guide 24*a* is changed depending on the position of the door 90. The other configurations are similar to the configurations according to the first exemplary embodiment. Therefore, the same reference numerals are assigned to the similar configurations, and detailed descriptions thereof are omitted.

In a case of adopting the configuration discussed in Japanese Patent Application Laid-Open No. 2015-227907, a relationship between a protruding amount of the sheet conveyance guide and a protruding amount of an upstream conveyance guide into the conveyance path when the sheet conveyance guide is moved in conjunction with the door due to opening or closing of the door for a jam recovery or for attachment or detachment of a part is not restricted. Thus, if the protruding amounts into the conveyance path are reversed, a sheet jam may occur. To avoid jam caused by reversing of the protruding amounts, it is necessary to consider a structure where the shape of the moving conveyance guide is complicated or strength in a vicinity of a delivery portion between the conveyance guide and the upstream conveyance guide is reduced, and it is necessary to move a conveyance roller and the conveyance guide on a path where the conveyance roller and the conveyance guide are assumed to come dynamically into contact with each other. Thus, there are concerns that a desired conveyance path space may not be obtained due to deformation of the conveyance guide and that the conveyance roller may be damaged. On the other hand, even in a case where a moving region is restricted or a member for maintaining the shape of a portion serving as the conveyance path is added in order to avoid the above-described issues, a simple configuration is desired from viewpoints of an arrangement space and a cost. Therefore, in the present exemplary embodiment, a moving path of a conveyance guide member for ensuring conveyance performance is established in a space-saving and low-cost manner.

Figure 13:
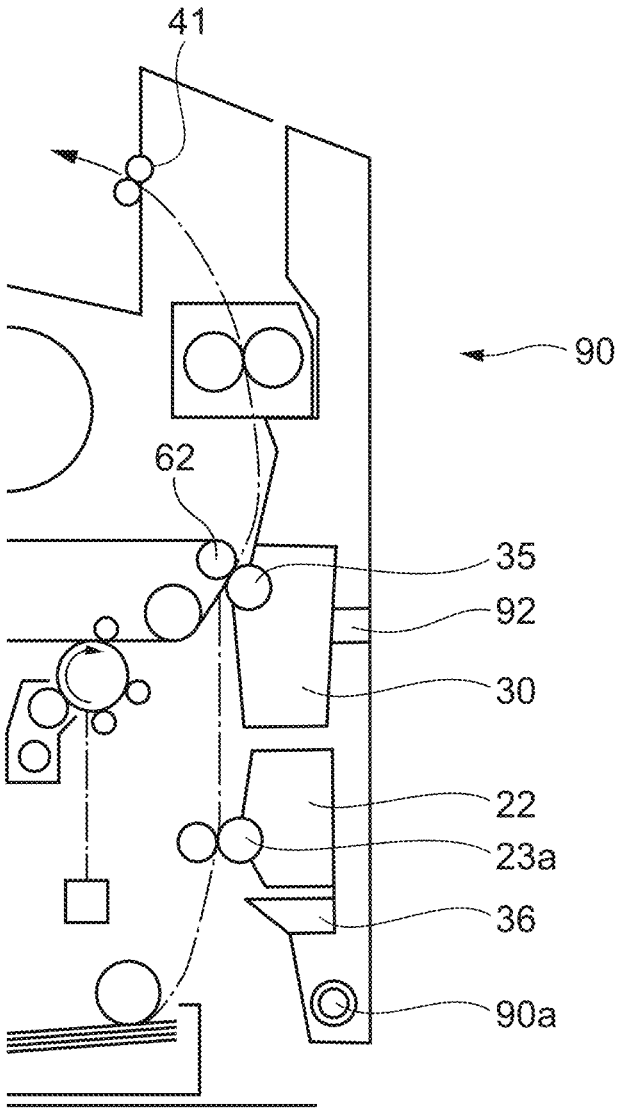
FIG. 13 is a front view illustrating a state where a door is at a closed position according to a second exemplary embodiment.
Figure 14:
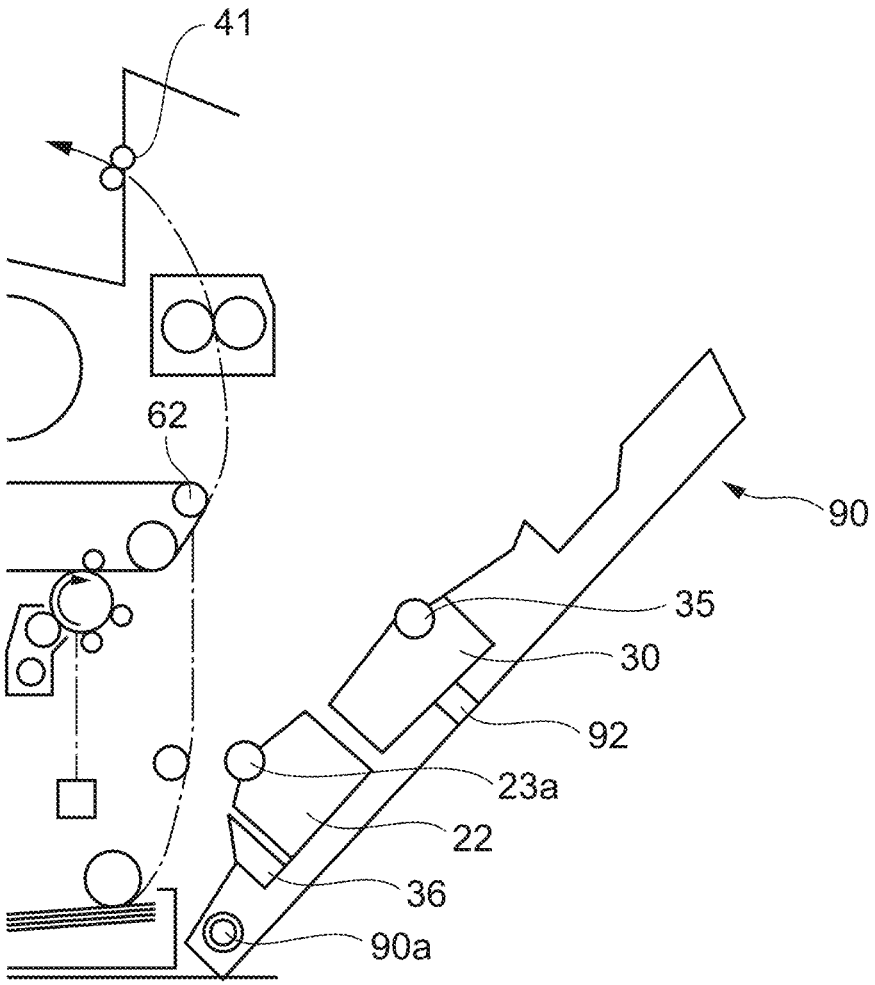
FIG. 14 is a front view illustrating a state where the door is at an intermediate position according to the second exemplary embodiment.
Figure 15:
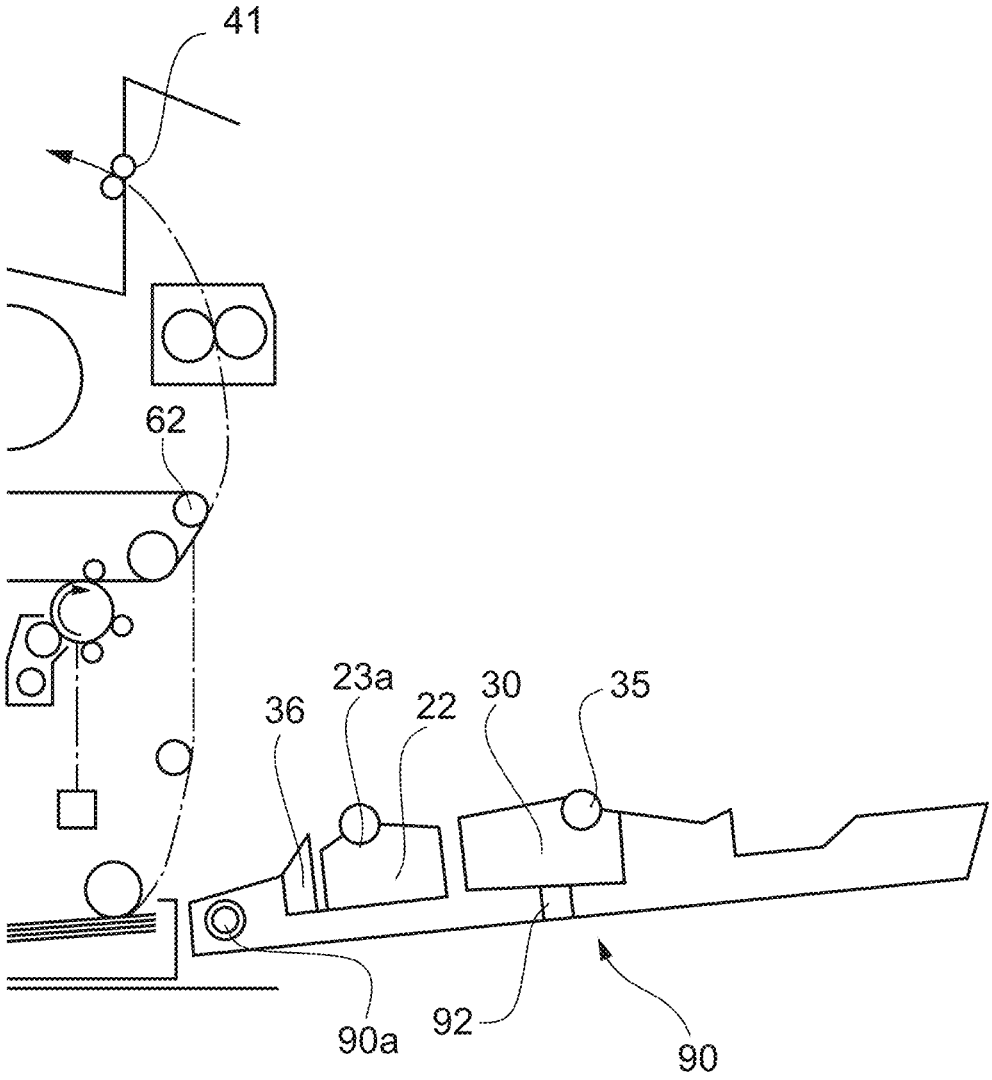
FIG. 15 is a front view illustrating a state where the door is at an open position according to the second exemplary embodiment.

Movements of the units during an opening or closing operation of the door 90 is described with reference to FIG. 13 to FIG. 16. FIG. 13 is a diagram illustrating the closed position (sheet feeding enabled state or standby state) of the door 90 according to the present exemplary embodiment. FIG. 14 is a diagram illustrating an intermediate position (jam recovery position) of the door 90. FIG. 15 is a diagram illustrating the open position (part replacement position) of the door 90. The door 90 mainly moves freely among three positions of the closed position, the intermediate position, and the open position. The closed position is a position (sheet feeding enabled state or standby state) where the door 90 is housed in the image forming apparatus 1. The intermediate position is a position intermediate between the closed position and the open position, and is a position (jam recovery position) where an operator clears a sheet jam and the like. The open position is a position (part replacement position) where the operator performs part replacement and the like.

During moving operation, the secondary transfer unit 30 is movable relative to the door 90 by the floating spring 92. Relative positions of the door 90, the secondary transfer unit 30, the guide unit 22, and a pre-registration guide 36 that is fixed to the door 90 and is positioned upstream of the guide unit 22 are different among the three positions. The pre-registration guide 36 is fixed to, for example, the door 90. The pre-registration guide 36 is an example of a third conveyance guide, is disposed upstream of the second conveyance guide 24*a* in the sheet conveyance direction, and is disposed on the door 90.

In the present exemplary embodiment, the pressing unit 29 described below is disposed on the pre-registration guide 36.

As illustrated in FIG. 13, when the door 90 is at the closed position, it is necessary that, at a delivery portion between the guide unit 22 and the pre-registration guide 36, a protruding amount of the pre-registration guide 36 into the conveyance path be greater than a protruding amount of the guide unit 22 into the conveyance path in order to avoid a jam. As illustrated in FIG. 14, when the door 90 is at the position (intermediate position) during the opening or closing operation, it is necessary that, at the delivery portion between the guide unit 22 and the pre-registration guide 36, the protruding amount of the guide unit 22 into the conveyance path be greater than the protruding amount of the pre-registration guide 36 into the conveyance path in order to achieve a positional relationship required in the closed state. As illustrated in FIG. 15, when the door 90 is at the open position, it is desirable that the guide unit 22 and the pre-registration guide 36 be retreated in order to improve workability.

[Configuration of Pressing Unit]

Figure 16:
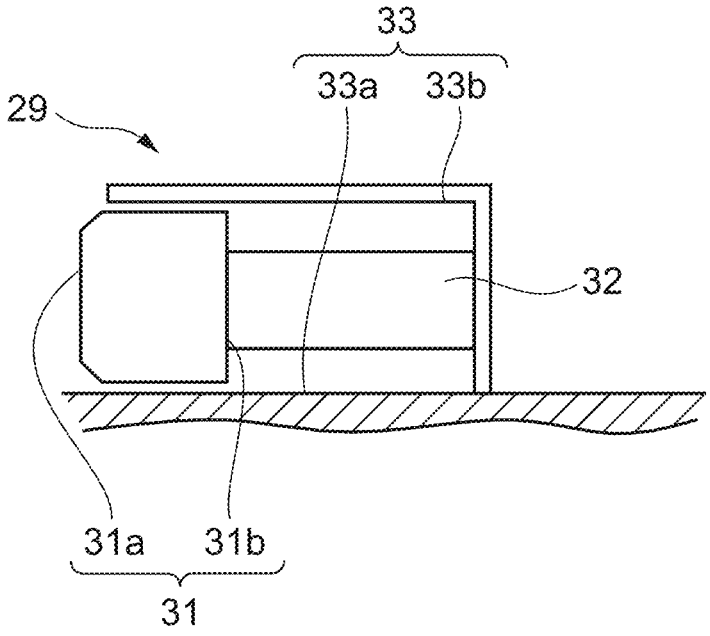
FIG. 16 is a cross-sectional view illustrating a pressing unit according to the second exemplary embodiment.
Figure 17:
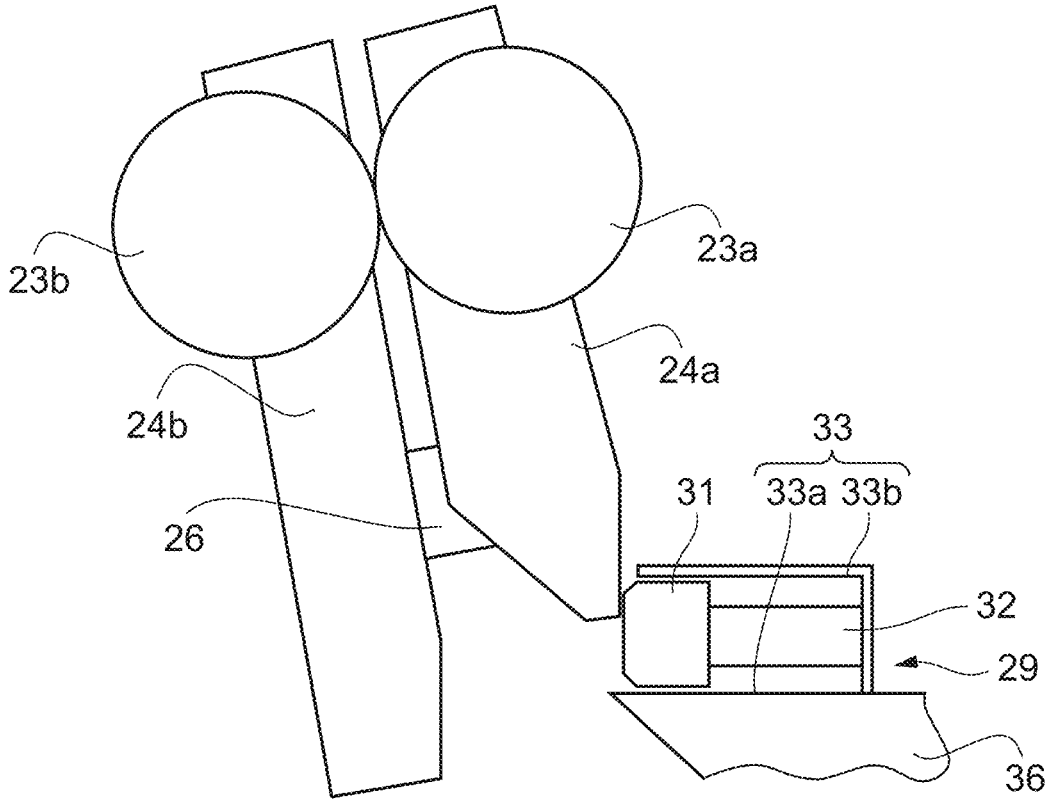
FIG. 17 is a cross-sectional view illustrating the pressing unit when the door is at the closed position according to the second exemplary embodiment.
Figure 18:
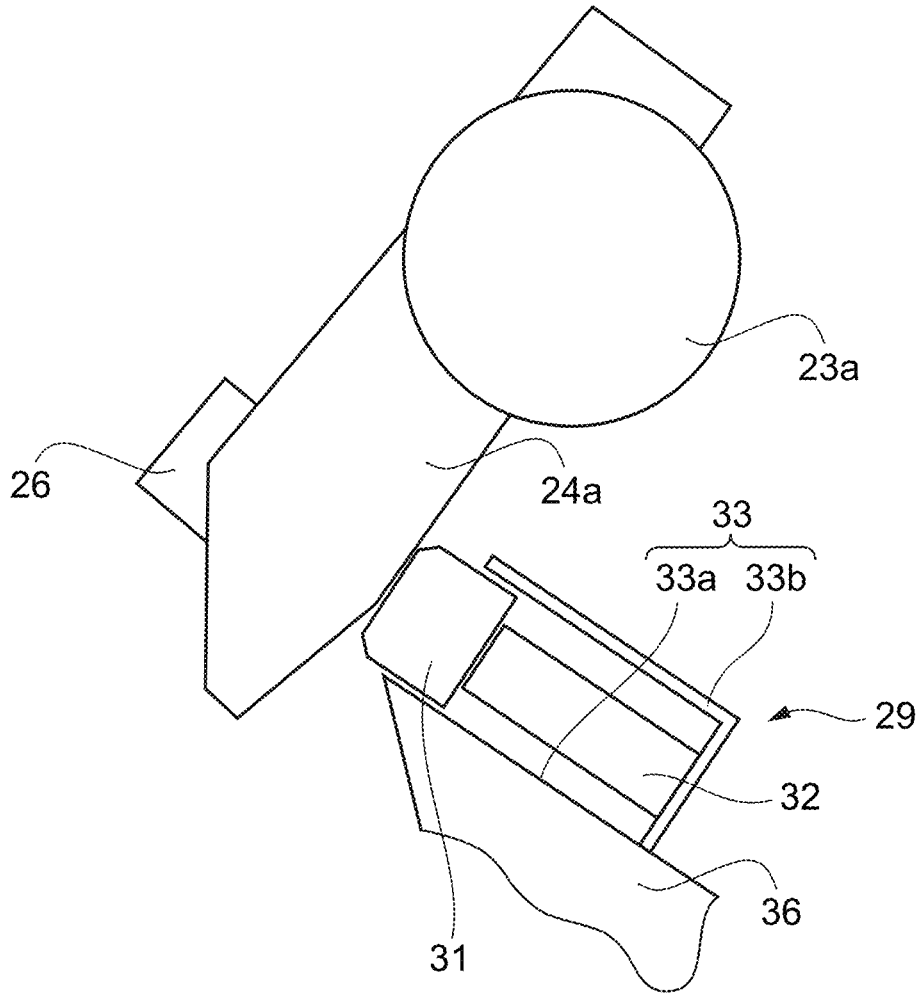
FIG. 18 is a cross-sectional view illustrating the pressing unit when the door is at the intermediate position according to the second exemplary embodiment.
Figure 19:
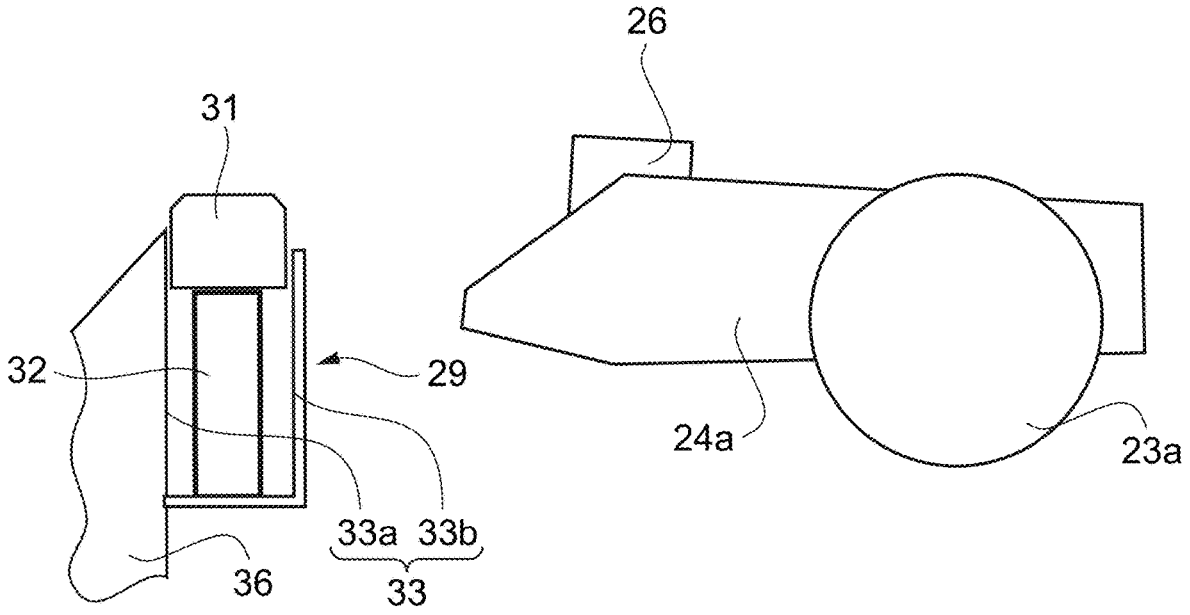
FIG. 19 is a cross-sectional view illustrating the pressing unit when the door is at the open position according to the second exemplary embodiment.

A configuration in a vicinity of the pressing unit 29 is described with reference to FIG. 16 to FIG. 19. FIG. 16 is a diagram illustrating a configuration of the pressing unit 29. FIG. 17 is a cross-sectional view illustrating a relationship between the guide unit 22 and the pressing unit 29 when the door 90 is at the closed position. FIG. 18 is a cross-sectional view illustrating the relationship between the guide unit 22 and the pressing unit 29 when the door 90 is at the intermediate position. FIG. 19 is a cross-sectional view illustrating the relationship between the guide unit 22 and the pressing unit 29 when the door 90 is at the open position. In the present exemplary embodiment, the pressing unit 29 is an example of a first urging portion.

As illustrated in FIG. 16, the pressing unit 29 includes a pressing portion 31, an urging spring 32, and a slide guide member 33. The pressing portion 31 includes a guide pressing surface 31*a* and a spring bearing surface 31*b*. The pressing portion 31 is supported by slide guide portions 33*a* and 33*b* of the slide guide member 33, or supported by the urging spring 32 having a diameter sufficiently greater than the pressing portion 31, or supported by both, so as not to be tilted. As a result, even in a case where the pressing unit 29 performs both a pressing function and a guiding function, the pressing unit 29 can perform the functions with a desired pressing force.

As illustrated in FIG. 17, to achieve a desired conveyance path space when the door 90 is in the closed state, the pressing unit 29 causes the second conveyance guide 24*a* to be in contact with the first conveyance guide 24*b* via the guide unit 22 to determine the attitude. A counter member with which the second conveyance guide 24*a* is in contact may not be the first conveyance guide 24*b*, and may be a main body frame or a positioning fixing member. As a result, the attitudes of the second conveyance guide 24*a* and the guide unit 22 are uniformly determined when the door 90 is in the closed state, without being affected by a position change occurring every time the door 90 is opened and closed. Therefore, the relationship of the protruding amounts of the second conveyance guide 24*a* and the pre-registration guide 36 in a substantially normal direction of the conveyance path is also uniformly determined, which makes it possible to achieve formation of the desired conveyance path.

In a transition state between the closed state and the open state of the door 90, i.e., in a state during the opening or closing operation of the door 90, the pressing unit 29 restricts the moving region of the guide unit 22. FIG. 18 illustrates a state during the opening or closing operation when the door 90 is at the intermediate position. During the opening or closing operation, the second conveyance guide 24*a* freely pivots about the registration driving roller 23*a* integrated with the second conveyance guide 24*a*. Therefore, it is difficult to control the positional relationship with the pre-registration guide 36 upstream in the conveyance path.

To resolve such difficulty, the pressing unit 29 presses a part of the movable guide unit 22. As a result, the guide unit 22 is guided to form a moving path that maintains the relationship in which, at the delivery portion between the second conveyance guide 24*a* and the pre-registration guide 36, the protruding amount of the second conveyance guide 24*a* is greater than the protruding amount of the pre-registration guide 36.

This makes it possible to avoid a situation where, for example, the guide unit 22 unintentionally collides with the registration driving roller 23*a* or the pre-registration guide 36 while moving.

As illustrated in FIG. 19, when the door 90 is at the open position, the pressing unit 29 is separated from the second conveyance guide 24*a*. When the positional relationship is achieved, a retreat amount of the guide unit 22 when the door 90 is at the open position is increased, and an improvement of workability during jam recovery and part replacement can be expected.

In the present exemplary embodiment, the second conveyance guide 24*a* is movable in a direction intersecting an urging direction in which the pressing unit 29 urges the second conveyance guide 24*a*. When the door 90 is at a position within a range from the closed position to the intermediate position, the second conveyance guide 24*a* is at a position in the urging direction of the pressing unit 29, and is urged by the pressing unit 29 (see FIG. 17 and FIG. 18). When the door 90 is at the open position, the second conveyance guide 24*a* is moved to a position not in the urging direction of the pressing unit 29 (see FIG. 19).

In the state illustrated in FIG. 18, with the own weight of the secondary transfer unit 30 coupled with the second conveyance guide 24*a*, the second conveyance guide 24*a* is urged leftward. When no external force acts in the state, the state illustrated in FIG. 17 is established. In contrast, when the door 90 is slightly opened from the state illustrated in FIG. 18 and the second conveyance guide 24*a* is separated from the pressing unit 29, with the own weight of the secondary transfer unit 30, the second conveyance guide 24*a* is urged rightward. When no external force acts in the state, the state illustrated in FIG. 19 is established.

As described above, in the image forming apparatus 1 according to the present exemplary embodiment, the single pressing unit 29 can perform pressing to guide the path and maintaining the attitude of the second conveyance guide 24*a*. Therefore, it is possible to achieve establishment of the moving path of the second conveyance guide 24 for ensuring the conveyance performance and pressing for maintaining the attitude in a space-saving and low-cost manner. Further, since the above-described effects are achievable by using the pressing unit 29 that has the pressing function and the function of guiding the second conveyance guide 24*a*, it is possible to provide the image forming apparatus 1 that achieves ensuring the conveyance performance and the workability during the jam recovery, the part replacement, and the like.

In the image forming apparatus 1 according to the present exemplary embodiment, when the door 90 is at the open position, the second conveyance guide 24*a* is separated from the pressing unit 29. Therefore, the second conveyance guide 24*a* is lowered by the own weight without being pushed upward. As a result, the second conveyance guide 24*a* is not in the way during maintenance, such as replacement of the intermediate transfer belt 61, which makes it possible to improve the workability. When the door 90 is closed, the second conveyance guide 24*a* protrudes once into the sheet conveyance path and is then separated from the sheet conveyance path, as compared with the pre-registration guide 36. This makes it possible to smoothly perform the conveyance of the sheet when the door 90 is closed.

While exemplary embodiments have been described, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2023-119367, filed Jul. 21, 2023, which is hereby incorporated by reference herein in its entirety.

What is claimed is:

1. An image forming apparatus, comprising:

an image forming main body unit including an image forming unit configured to form an image to be transferred to a sheet;

an openable and closable portion disposed on the image forming main body unit to be pivotable about a pivot shaft, the openable and closable portion being disposed to be openable and closable by pivoting between a closed position where a sheet conveyance path is formed and an open position where the sheet conveyance path is opened;

a registration roller pair including a first roller and a second roller and configured to nip and convey the sheet, the first roller being disposed on the image forming main body unit, the second roller being disposed on the openable and closable portion and configured to form, with the first roller, a nip configured to nip the sheet when the openable and closable portion is at the closed position;

a holding portion configured to hold the second roller of the registration roller pair to form the nip with the first roller when the openable and closable portion is at the closed position;

a first conveyance guide disposed on the image forming main body unit upstream of the registration roller pair in a sheet conveyance direction;

a second conveyance guide configured to be pivotable about the second roller of the registration roller pair and configured to face the first conveyance guide and guide, with the first conveyance guide, the sheet to the registration roller pair when the openable and closable portion is at the closed position;

a first urging portion disposed on the openable and closable portion and configured to urge the second conveyance guide toward the first conveyance guide when the openable and closable portion is at the closed position; and an abutting portion disposed on the second conveyance guide and configured to be in contact with the first conveyance guide when the second conveyance guide is urged toward the first conveyance guide by the first urging portion when the openable and closable portion is at the closed position.

2. The image forming apparatus according to claim 1, wherein the second roller is rotatable relative to the second conveyance guide.

3. The image forming apparatus according to claim 1, wherein the second conveyance guide is movable in a direction intersecting an urging direction of the first urging portion, wherein, when the openable and closable portion is at a position within a range from the closed position to an intermediate position intermediate between the open position and the closed position, the second conveyance guide is at a position in the urging direction of the first urging portion and is urged by the first urging portion, and wherein, when the openable and closable portion is at the open position, the second conveyance guide is moved to a position not in the urging direction of the first urging portion.

4. The image forming apparatus according to claim 3, further comprising a third conveyance guide disposed on the openable and closable portion upstream of the second conveyance guide in the sheet conveyance direction, wherein the first urging portion is provided on the third conveyance guide.

5. The image forming apparatus according to claim 1, wherein the holding portion is a first holding portion, wherein the image forming unit includes an image bearing member, a transfer roller, and a transfer guide, the image bearing member being disposed while being positioned to the image forming main body unit and configured to carry a toner image, the transfer roller being disposed on the openable and closable portion and configured to form a nip portion by coming into contact with the image bearing member when the openable and closable portion is at the closed position and to transfer the toner image borne on the image bearing member to the sheet at the nip portion, the transfer guide being configured to support the transfer roller and to guide the sheet toward the nip portion, and wherein the image forming apparatus includes a second holding portion disposed on the image forming main body unit and configured to hold the transfer guide to position the transfer roller relative to the image bearing member when the openable and closable portion is at the closed position.

6. The image forming apparatus according to claim 5, wherein, when the openable and closable portion is at the open position, the transfer guide is movable relative to the openable and closable portion.

7. The image forming apparatus according to claim 6, wherein the transfer guide includes a shaft portion having a center axis in a width direction intersecting the sheet conveyance direction, wherein the image forming main body unit includes a groove portion with which the shaft portion engages, and wherein, when the openable and closable portion pivots from the open position to the closed position, the shaft portion engages with the groove portion, and the transfer guide pivots about the shaft portion and is positioned relative to the image forming main body unit.

8. The image forming apparatus according to claim 1, wherein the holding portion includes a restricting member and a second urging portion, the restricting member being disposed on the image forming main body unit and movable to a restricting position located opposite to the first roller with the second roller therebetween in a direction of a virtual line connecting a rotation center of the first roller and a rotation center of the second roller when the openable and closable portion is at the closed position and to a release position retreated from the restricting position, the second urging portion being disposed on the image forming main body unit and urging the first roller toward the second roller, wherein, when the openable and closable portion is at the closed position, the restricting member is at the restricting position, and the second urging portion urges the first roller toward the second roller, brings a rotary shaft of the second roller into contact with the restricting member, and positions the registration roller pair relative to the image forming main body unit, and wherein, when the openable and closable portion is at the open position, the restricting member is at the release position to cancel positioning of the second roller.

9. The image forming apparatus according to claim 8, wherein the restricting member includes a guided portion and is disposed to be pivotable relative to the image forming main body unit, and wherein the openable and closable portion includes a guide portion configured to guide the guided portion to cause the restricting member positioned at the release position to pivot when the openable and closable portion pivots from the open position to the closed position, and to position the restricting member at the restricting position when the openable and closable portion is at the closed position.

* * * * *